US008118299B2

(12) United States Patent
Sato

(10) Patent No.: US 8,118,299 B2
(45) Date of Patent: Feb. 21, 2012

(54) MANUAL SHEET FEEDER AND IMAGE FORMING APPARATUS INCLUDING SAME

(75) Inventor: Masashi Sato, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 154 days.

(21) Appl. No.: 12/629,391

(22) Filed: Dec. 2, 2009

(65) Prior Publication Data

US 2010/0133741 A1 Jun. 3, 2010

(30) Foreign Application Priority Data

Dec. 3, 2008 (JP) ..... 2008-308076

(51) Int. Cl.
*B65H 3/06* (2006.01)

(52) U.S. Cl. ..... 271/118; 271/117; 271/121; 271/122

(58) Field of Classification Search ..... 271/117, 271/118, 121, 122
See application file for complete search history.

(56) References Cited

U.S. PATENT DOCUMENTS 6,131,898 A * 10/2000 Hiroi et al. ..... 271/10.03
6,493,113 B1 * 12/2002 Fujii et al. ..... 358/488
6,554,270 B2 * 4/2003 Yamamoto ..... 271/117
7,571,905 B2 * 8/2009 Kim ..... 271/117
2002/0033572 A1 * 3/2002 Takisawa et al. ..... 271/109
2006/0049572 A1 * 3/2006 Miyazawa ..... 271/121

FOREIGN PATENT DOCUMENTS

JP 2-13542 1/1990
JP 8-277044 10/1996
JP 9-90687 4/1997
JP 2002-96935 4/2002

* cited by examiner

*Primary Examiner* — Michael McCullough
*Assistant Examiner* — Howard Sanders
(74) *Attorney, Agent, or Firm* — Cooper & Dunham LLP

(57) ABSTRACT

A manual sheet feeder including a pickup roller; a pickup arm; a sheet stopper; a rotation regulation member; a solenoid including a movable core having a straight line motion; a solenoid link rotatively coupled to the movable core; and a first spring to bias the pickup arm in a direction in which the pickup arm is rotated downward. At start of sheet feeding operation, the pickup arm is rotated by the first spring in a direction in which the pickup roller is moved downward in conjunction with rotation of the solenoid link caused by the straight line motion of the movable core in one direction, and the rotation regulation member is rotated in conjunction with the rotation of the solenoid link caused by the straight line motion of the movable core in the one direction to release regulation of rotation of the sheet stopper.

12 Claims, 8 Drawing Sheets

MANUAL SHEET FEEDER AND IMAGE FORMING APPARATUS INCLUDING SAME

BACKGROUND

1. Technical Field

This disclosure relates to a manual sheet feeder employed in an image forming apparatus such as a copier, a printer, a facsimile machine, and so forth, and more particularly to a manual sheet feeder including a sheet stopper, and an image forming apparatus including the manual sheet feeder.

2. Description of the Background

Recently, a type of sheets usable in image forming apparatuses such as copiers and so forth has been increased with market expansion, increasing demand for user-friendly manual sheet feeders for use in the image forming apparatuses.

Manual sheet feeders employed in such image forming apparatuses generally include a sheet stopper for stopping and aligning a leading edge of a stack of sheets manually inserted into the manual sheet feeder. The sheet stopper prevents the leading edge of the stack of the sheets from entering between sheet feed rollers even when the stack of the sheets is set haphazardly in a sheet tray, thereby preventing misfeeds in the form of multiple sheets from being fed at one time or sheets being diagonally fed. Further, proper alignment of the leading edge of the manually fed stack of sheets is of increasing importance in order to satisfy increasing demand for higher printing speed.

Published Unexamined Japanese Patent Application No. 2002-96935 (hereinafter referred to as JP-2002-96935-A) discloses a manual sheet feeder including a sheet stopper. The sheet stopper is caused to contact a leading edge of a sheet in conjunction with rotation of a pickup arm that moves a pickup roller upward and downward.

FIG. 1 is a vertical cross-sectional view illustrating a configuration of the manual sheet feeder of the related art disclosed in JP-2002-96935-A. Referring to FIG. 1, a manual sheet feeder 10 includes a pickup roller 12 rotatably provided to a pickup arm 16 rotating around a shaft 14 of a sheet feed roller 14*a*. When the sheet feed roller 14*a* is rotated, the pickup roller 12 is rotated by gears, not shown. A separation roller 14*b* is provided to contact the sheet feed roller 14*a*. Further, a stopper release member 18 is integrally formed with the pickup arm 16.

The manual sheet feeder 10 further includes a sheet stopper 20 rotatably provided thereto. The sheet stopper 20 includes a first arm 20*a* and a second arm 20*b* each extending from a rotary shaft 22 in a direction opposite to each other. A linear portion L is provided at a leading edge of the second arm 20*b*.

A regulation member 24 for regulating rotation of the sheet stopper 20 is rotatably provided to the manual sheet feeder 10. The regulation member 24 includes a first arm 24*a* and a second arm 24*b* each extending from a rotary shaft 26 in a direction substantially perpendicular to each other. A protrusion M to engage with the linear portion L provided to the second arm 20*b* of the sheet stopper 20 is provided at a leading edge of the second arm 24*b* of the regulation member 24.

FIG. 1 illustrates a state in which the pickup roller 12 is moved upward so that the protrusion M provided to the second arm 24*b* of the regulation member 24 engages with the linear portion L provided to the second arm 20*b* of the sheet stopper 20. Accordingly, rotation of the sheet stopper 20 is regulated, and the sheet stopper 20 is positioned at a standby position. As a result, when a stack of sheets S is manually inserted into a sheet tray 28, a leading edge of the stack of the sheets S is stopped and aligned by the sheet stopper 20.

When sheet feeding is started, the sheet feed roller 14*a* is rotated, and the pickup roller 12 is also rotated in conjunction with rotation of the sheet feed roller 14*a*. The pickup arm 16 is rotated downward so that the pickup roller 12 is moved downward to contact a top surface of the stack of the sheets S in the sheet tray 28.

The downward rotation of the pickup arm 16 causes the stopper release member 18 integrally formed with the pickup arm 16 to press the first arm 24*a* of the regulation member 24 so that the regulation member 24 is rotated in a counterclockwise direction in FIG. 1. Accordingly, the protrusion M provided to the second arm 24*b* of the regulation member 24 is released from the linear portion L of the sheet stopper 20. As a result, regulation of rotation of the sheet stopper 20 is released, and the sheet stopper 20 is now rotatable.

The sheet S fed from the sheet tray 28 by the pickup roller 12 pushes the first arm 20*a* of the sheet stopper 20 now rotatable, so that the sheet S is conveyed between the sheet feed roller 14*a* and the separation roller 14*b* while rotating the sheet stopper 20 in a clockwise direction in FIG. 1.

When sheet feeding is completed, the sheet stopper 20 is rotated in a counterclockwise direction in FIG. 1 by moment of inertia to return to the standby position. Meanwhile, the regulation member 24 is rotated in a clockwise direction in FIG. 1 by moment of inertia, so that the protrusion M provided to the second arm 24*b* of the regulation member 24 engages with the linear portion L provided to the second arm 20*b* of the sheet stopper 20.

In the manual sheet feeder 10 disclosed in JP-2002-96935-A described above, when a larger number of the sheets S is placed on the sheet tray 28, the pickup roller 12 contacts a top surface of the stack of the sheets S immediately after being moved downward at the start of sheet feeding. As a result, an amount of downward movement of the pickup roller 12 is reduced. In such a case, an amount of downward rotation of the pickup arm 16 is reduced as well, so that a distance in which the stopper release member 18 integrally formed with the pickup arm 16 pushes the first arm 24*a* of the regulation member 24 is also reduced. Consequently, an amount of rotation of the regulation member 24 in a counterclockwise direction in FIG. 1 is reduced, and that makes it difficult to release the second arm 20*b* of the sheet stopper 20 from the second arm 24*b* of the regulation member 24.

Therefore, when the larger number of the sheets S is placed on the sheet tray 28, it is difficult to release regulation of rotation of the sheet stopper 20 in the manual sheet feeder 10 of JP-2002-96935-A.

Further, when sheet feeding is completed, the regulation member 24 and the sheet stopper 20 are caused to engage with each other by rotation of each of the sheet stopper 20 and the regulation member 24 caused by moment of inertia as described above. Consequently, each of the sheet stopper 20 and the regulation member 24 may not be reliably rotated, preventing engagement of the regulation member 24 with the sheet stopper 20.

Therefore, rotation of the sheet stopper 20 at the completion of sheet feeding may not be reliably regulated, ultimately causing paper misfeeds or the like.

BRIEF SUMMARY

In an aspect of this disclosure, a manual sheet feeder is provided to stop and align a leading edge of a stack of sheets in a sheet tray at a certain position using a sheet stopper even when the stack of sheets is swiftly inserted into the sheet tray.

In addition, even when a larger number of sheets is placed on the sheet tray, regulation of rotation of the sheet stopper is reliably released.

Further, rotation of the sheet stopper is reliably regulated at completion of sheet feeding.

In another aspect of this disclosure, an image forming apparatus including the manual sheet feeder described above is provided.

In an illustrative embodiment, a manual sheet feeder includes a pickup roller provided to contact a sheet placed on a sheet tray to convey the sheet to a sheet feed roller; a pickup arm rotatably provided to a shaft of the sheet feed roller to rotatably support the pickup roller; a sheet stopper rotatably provided to stop and align a leading edge of the sheet placed on the sheet tray; a rotation regulation member rotatably provided to regulate rotation of the sheet stopper in a direction of sheet feed by engaging with the sheet stopper positioned at a standby position; a solenoid including a movable core having a straight line motion; a solenoid link rotatively coupled to the movable core; and a first spring to bias the pickup arm in a direction in which the pickup arm is rotated downward. At start of sheet feeding operation, the pickup arm is rotated by the first spring in a direction in which the pickup roller is moved downward in conjunction with rotation of the solenoid link caused by the straight line motion of the movable core in one direction, and the rotation regulation member is rotated in conjunction with the rotation of the solenoid link caused by the straight line motion of the movable core in the one direction to release regulation of rotation of the sheet stopper by releasing engagement with the sheet stopper.

In another illustrative embodiment, an image forming apparatus includes the manual sheet feeder described above.

The aforementioned and other aspects, features and advantages will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE ILLUSTRATIVE EMBODIMENTS

Figure 1:
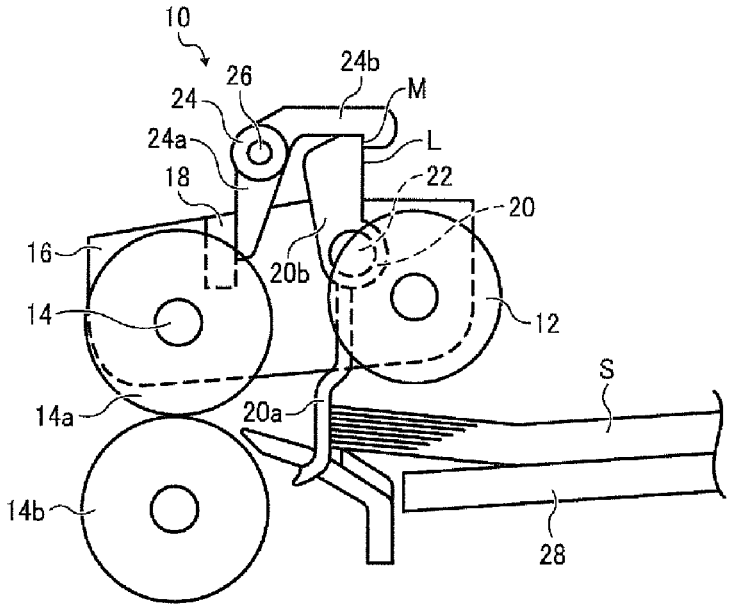
FIG. 1 RELATED ART
FIG. 1 is a vertical cross-sectional view illustrating a configuration of a manual sheet feeder of the related art.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

A description is now given of a configuration of a manual sheet feeder 30 according to illustrative embodiments.

Figure 2:
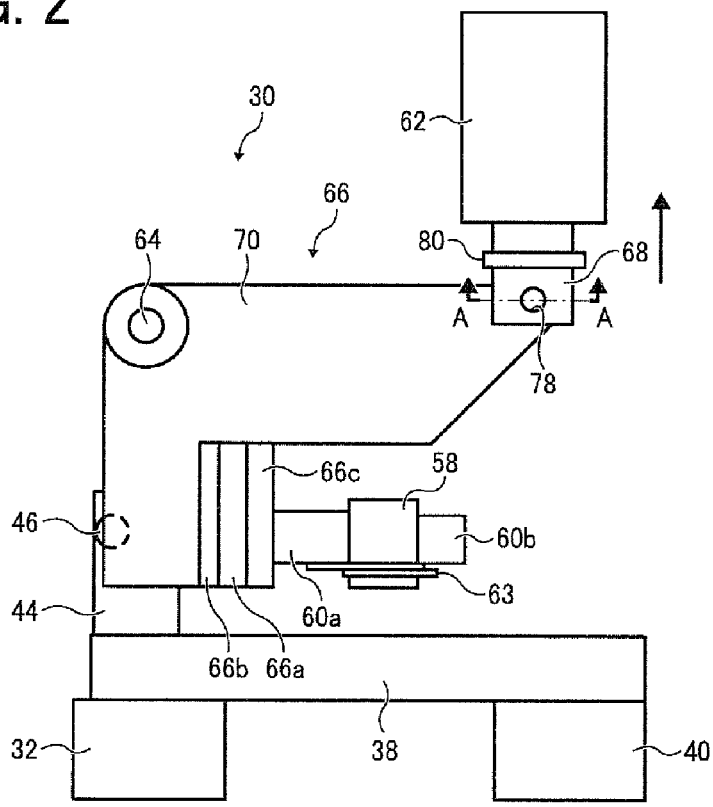
FIG. 2 is a plan view illustrating a configuration of a manual sheet feeder according to illustrative embodiments.
Figure 3A:
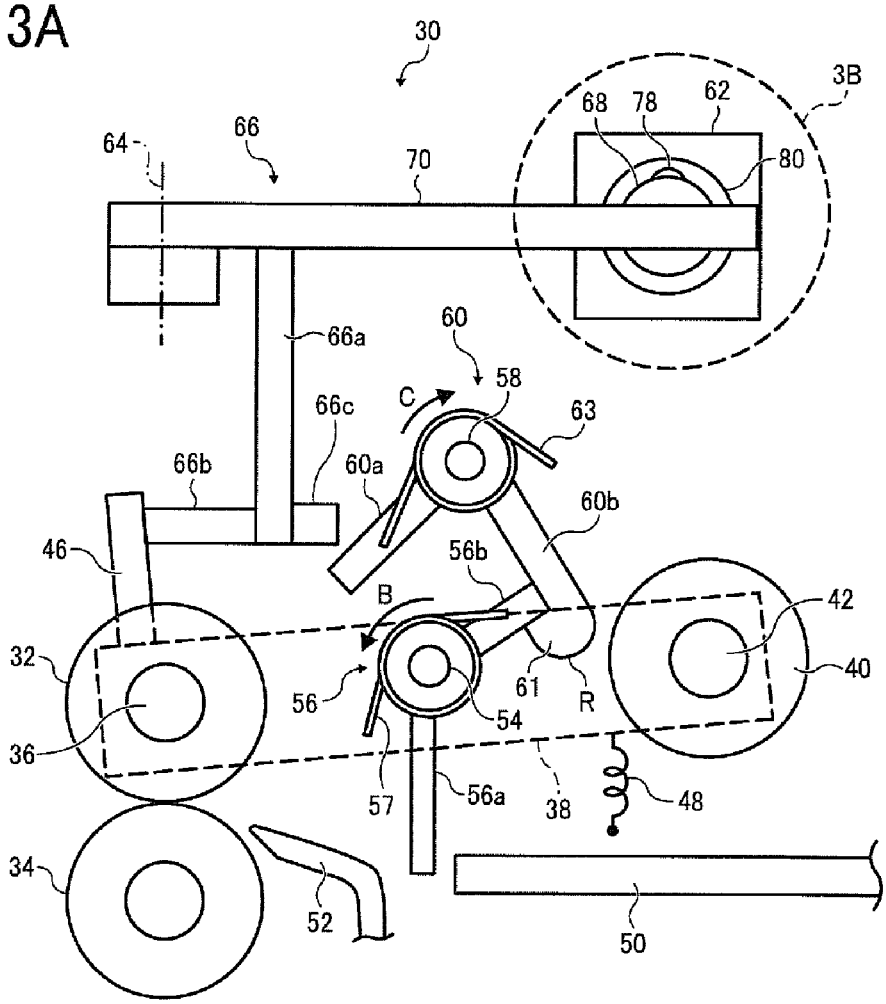
FIG. 3A is a vertical cross-sectional view illustrating the configuration of the manual sheet feeder illustrated in FIG. 2.

FIG. 2 is a plan view, and FIG. 3A is a vertical cross-sectional view, respectively illustrating the manual sheet feeder 30 according to illustrative embodiments.

The manual sheet feeder 30 includes a sheet feed roller 32, a separation roller 34, and a pickup arm 38. An end of the pickup arm 38 is rotatably supported by a shaft 36 of the sheet feed roller 32 so that the pickup arm 38 is rotated around the shaft 36. At the other end of the pickup arm 38, a pickup roller 40 is rotatably supported by a shaft 42. The pickup roller 40 is rotated in conjunction with rotation of the sheet feed roller 32 via gears, not shown. The pickup arm 38 includes a base 44 extending in a horizontal direction at an end thereof. A contact arm 46 is fixed to an upper portion of the base 44.

It is to be noted that, in FIG. 3A, the pickup arm 38 is illustrated by broken lines for ease of understanding. The pickup arm 38 is biased by a spring such as a coil spring 48 to be rotated downward.

A sheet tray 50 is provided below the pickup roller 40. For simplification, the sheet tray 50 is not shown in FIG. 2. A conveyance guide 52 to guide a sheet fed from the sheet tray 50 to a position between the sheet feed roller 32 and the separation roller 34 is provided on a downstream side from the sheet tray 50 relative to a direction of conveyance of the sheet, that is, a direction of sheet feed.

A sheet stopper 56 rotatably supported by a shaft 54 fixed to a housing of the manual sheet feeder 30, not shown, is provided above a portion between the sheet tray 50 and the conveyance guide 52. The sheet stopper 56 includes a first arm 56*a* and a second arm 56*b* each extending in a direction perpendicular to a longitudinal direction of the shaft 54.

A rotation regulation member 60 rotatably supported by a shaft 58 fixed to the housing of the manual sheet feeder 30, not shown, is provided above the sheet stopper 56. The rotation regulation member 60 includes a first arm 60*a* and a second arm 60*b* each extending in a direction perpendicular to a longitudinal direction of the shaft 58. A protrusion 61 is provided at a leading edge of the second arm 60*b* to engage with the second arm 56*b* of the sheet stopper 56. An outer surface of the protrusion 61 is formed with a curved surface R.

The sheet stopper 56 is biased by a spring such as a torsion spring 57 to be rotated in a direction indicated by an arrow B in FIG. 3A, that is, a counterclockwise direction in FIG. 3A. A lock member, not shown, is provided to the pickup arm 38 such that rotation of the sheet stopper 56 in the counterclockwise direction is stopped at a position of the sheet stopper 56 as illustrated in FIG. 3A, that is, a position where the first arm 56*a* of the sheet stopper 56 is positioned to stop a leading edge of a stack of sheets placed on the sheet tray 50 (hereinafter referred to as a standby position).

The rotation regulation member 60 is biased by a spring such as a torsion spring 63 to be rotated in a direction indicated by an arrow C in FIG. 3A, that is, a clockwise direction in FIG. 3A.

The manual sheet feeder 30 further includes a solenoid 62 and a solenoid link 66 rotatably supported by a shaft 64 fixed to the housing of the manual sheet feeder 30, not shown.

The solenoid link 66 includes a plate-shaped connection part 70 extending in a horizontal direction and connected to a movable core 68 of the solenoid 62. The solenoid link 66 further includes a first arm 66*a* extending downward in a direction perpendicular to the connection part 70, and a second arm 66*b* and a third arm 66*c* each fixed to a bottom end of the first arm 66*a* and extending in opposite directions horizontally from both sides of the first arm 66*a*. A leading edge of the second arm 66*b* is configured to contact the contact arm 46 of the pickup arm 38. A leading edge of the third arm 66*c* is configured to contact the first arm 60*a* of the rotation regulation member 60.

Figure 3B:
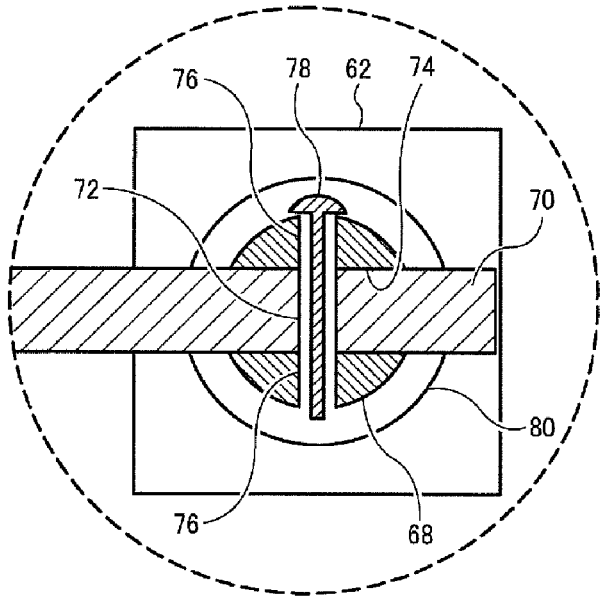
FIG. 3B is an enlarged cross-sectional view illustrating how a solenoid link is connected to a movable core of a solenoid.

The connection part 70 of the solenoid link 66 is connected to the movable core 68 of the solenoid 62 as follows. Specifically, as illustrated in FIG. 3B, which is an enlarged vertical cross-sectional view illustrating the connection part 70 of the solenoid link 66 and the movable core 68 of the solenoid 62 cut along a line A-A in FIG. 2, a hole 72 is provided at an end of the connection part 70 in a direction perpendicular to the connection part 70. The end of the connection part 70 engages with a notch 74 cut at a leading edge of the movable core 68 in a horizontal direction. When a pin 78 inserted into a hole 76 provided to the movable core 68 in a direction perpendicular to the movable core 68 passes through the hole 72 of the connection part 70, the connection part 70 and the movable core 68 are connected to each other. It is to be noted that an internal diameter of each of the holes 72 and 76 and an outer diameter of the pin 78 are determined to provide a space between the holes 72 and 76 and the pin 78 such that the solenoid link 66 can be rotated when the movable core 68 has straight line motion.

A flange-shaped stopper 80 is provided around an outer circumference of the movable core 68 to stop the straight line motion of the movable core 68 when the solenoid 62 is turned on to withdraw the movable core 68. In addition, a second stopper, not shown, is provided to stop the straight line motion of the movable core 68 when the solenoid 62 is turned off to push the movable core 68.

A description is now given of a series of sheet feeding operations performed by the manual sheet feeder 30 having the above-described configuration, with reference to FIGS. 2 to 8. It is to be noted that the torsion springs 57 and 63 are not Illustrated in FIGS. 4 to 8 for simplification.

In a state of rest when sheet feeding is not being performed, the solenoid 62 is turned off and the movable core 68 is pushed as illustrated in FIG. 2. At this time, the solenoid link 66 is rotated around the shaft 64 in a clockwise direction in FIG. 2.

Figure 4:
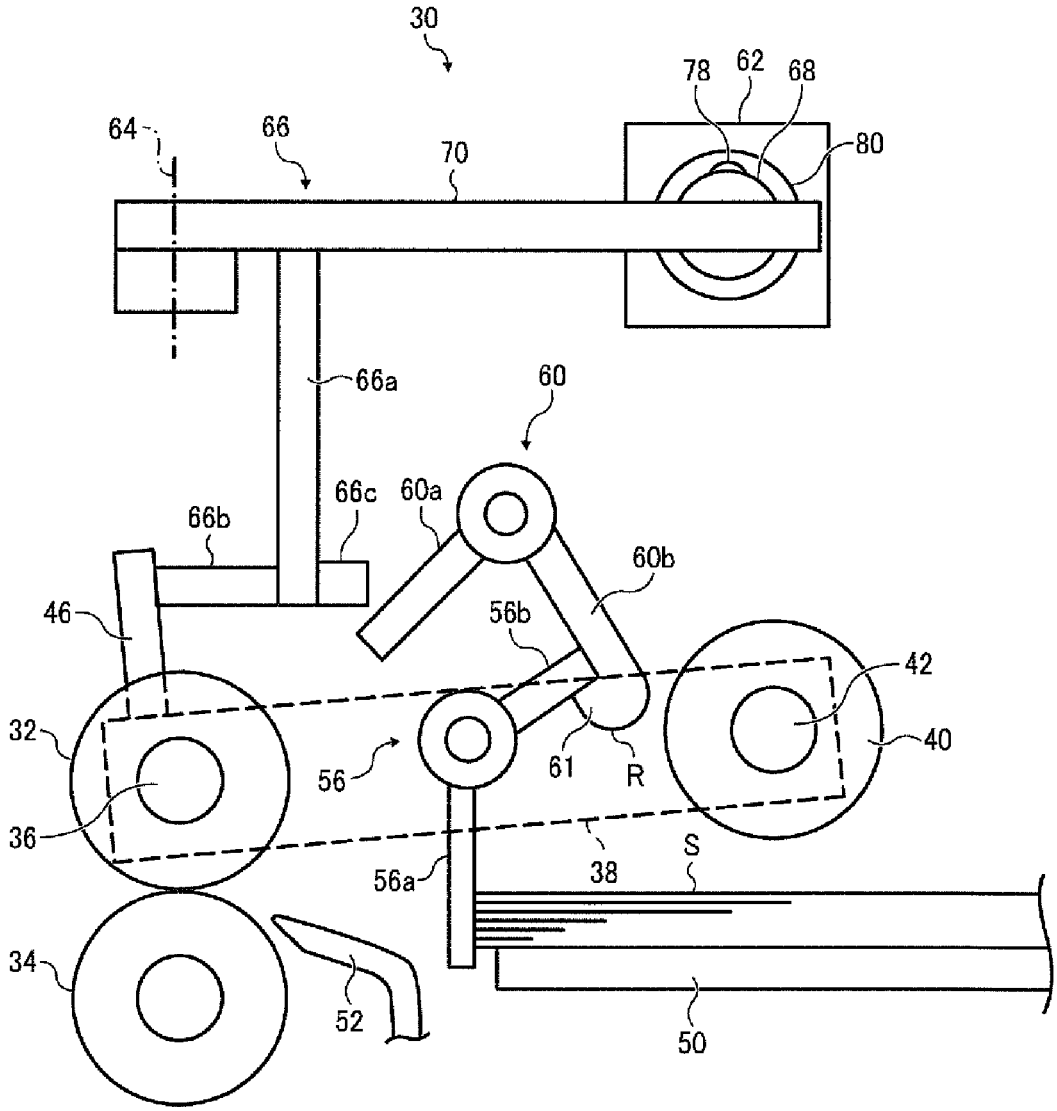
FIG. 4 is a vertical cross-sectional view illustrating the configuration of the manual sheet feeder when sheet feeding is not performed.

In such a state, the second arm 66*b* of the solenoid link 66 presses the contact arm 46 of the pickup arm 38 as illustrated in FIG. 4 to rotate the pickup arm 38 around the shaft 36 in a counterclockwise direction. As a result, the pickup roller 40 is moved upward.

At this time, the sheet stopper 56 is positioned at the standby position, and the second arm 56*b* engages with the second arm 60*b* of the rotation regulation member 60. In other words, rotation of the sheet stopper 56 in the direction of sheet feed is regulated. When a stack of sheets S is placed on the sheet tray 50 in such a state, a leading edge of the stack of the sheets S is stopped by the first arm 56*a* of the sheet stopper 56. Accordingly, the sheets S are reliably prevented from entering between the sheet feed roller 32 and the separation roller 34.

Prior to the start of sheet feeding, the sheet feed roller 32 is rotated in a clockwise direction, and the pickup roller 40 is rotated in a clockwise direction via gears, not shown. In addition, the separation roller 34 is rotated in a counterclockwise direction.

When sheet feeding is started, the solenoid 62 is turned on to withdraw the movable core 68. At this time, the solenoid link 66 is rotated around the shaft 64 in a counterclockwise direction in FIG. 2.

Figure 5:
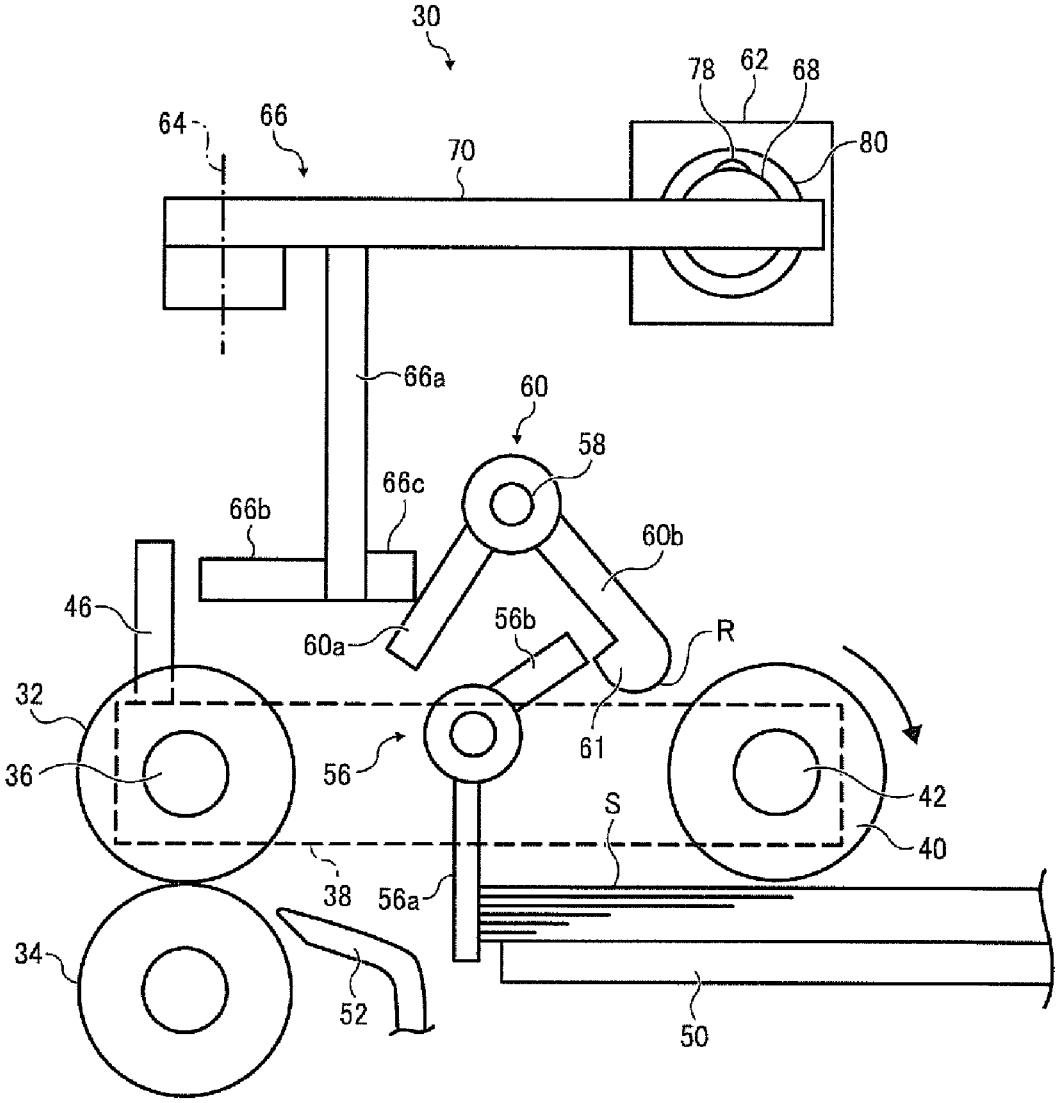
FIG. 5 is a vertical cross-sectional view illustrating the configuration of the manual sheet feeder when sheet feeding is started.

When the solenoid link 66 is rotated, the third arm 66*c* of the solenoid link 66 pushes the first arm 60*a* of the rotation regulation member 60 as illustrated in FIG. 5, so that the rotation regulation member 60 is rotated around the shaft 58 in a counterclockwise direction in FIG. 5. Accordingly, the second arm 60*b* of the rotation regulation member 60 is released from the second arm 56*b* of the sheet stopper 56, and regulation of rotation of the sheet stopper 56 is also released.

At the same time, the second arm 66*b* of the solenoid link 66 is separated from the contact arm 46 of the pickup arm 38 as illustrated in FIG. 5 due to rotation of the solenoid link 66, and the pickup arm 38 is rotated around the shaft 36 in a clockwise direction by the spring 48. As a result, the pickup roller 40 is moved downward to contact a top sheet of the stack of the sheets S (hereinafter referred to as a top sheet S) placed on the sheet tray 50.

Figure 6:
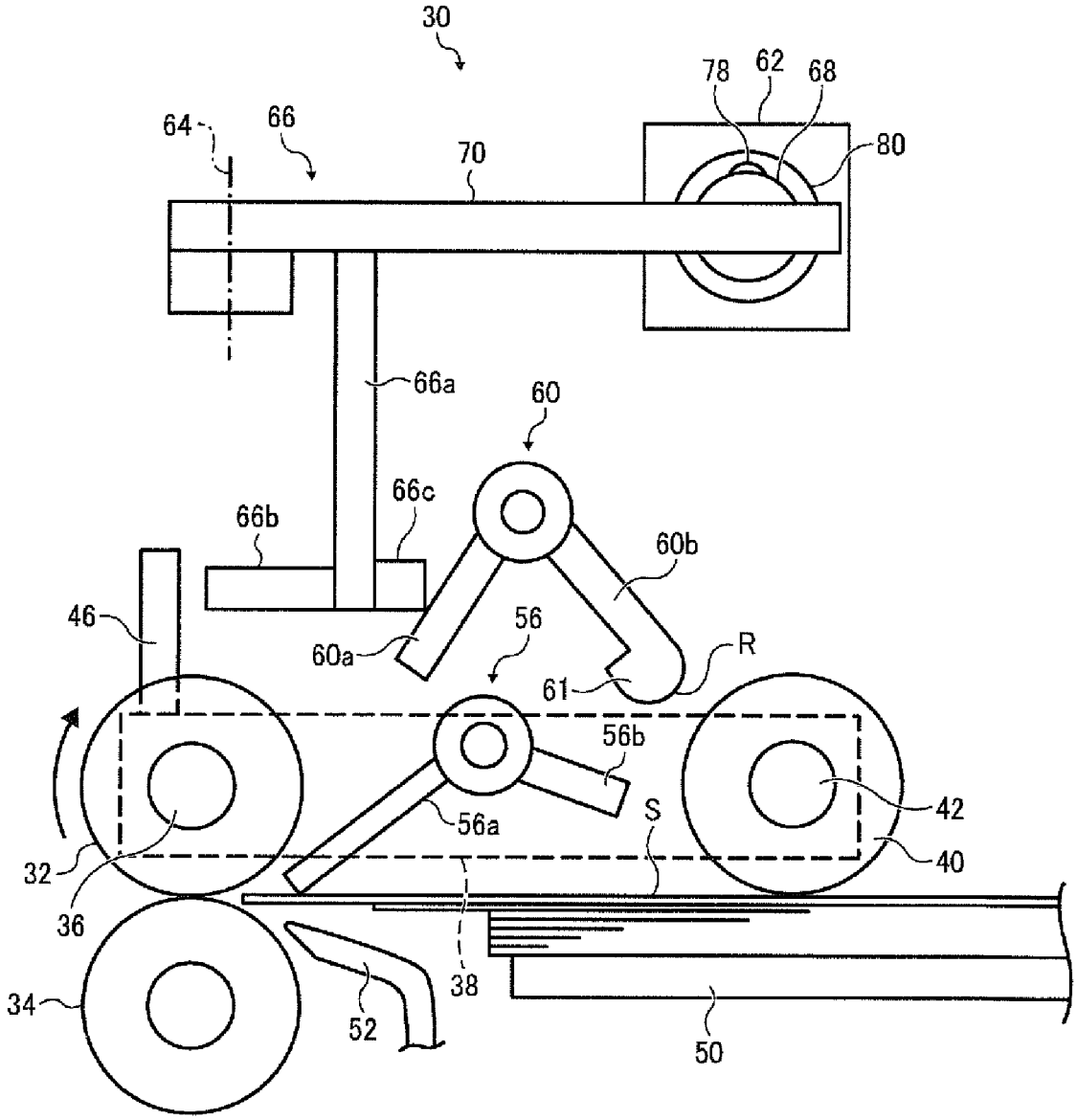
FIG. 6 is a vertical cross-sectional view illustrating the configuration of the manual sheet feeder when sheet feeding is performed.

As illustrated in FIG. 6, the top sheet S is fed from the sheet tray 50 by the pickup roller 40 and is conveyed between the sheet feed roller 32 and the separation roller 34. A leading edge of the top sheet S contacts the first arm 56*a* of the sheet stopper 56 while the top sheet S is conveyed. However, because rotation of the sheet stopper 56 is not regulated, the top sheet S rotates the sheet stopper 56 in a clockwise direction in FIG. 6 against a rotary force in the counterclockwise direction biased by the torsion spring 57, so that the top sheet S passes through the sheet stopper 56 and is conveyed between the sheet feed roller 32 and the separation roller 34.

When a rear edge of the top sheet S passes through the pickup roller 40, the solenoid 62 is turned off to push the movable core 68. Accordingly, the solenoid link 66 is rotated around the shaft 64 in a clockwise direction in FIG. 2.

Figure 7:
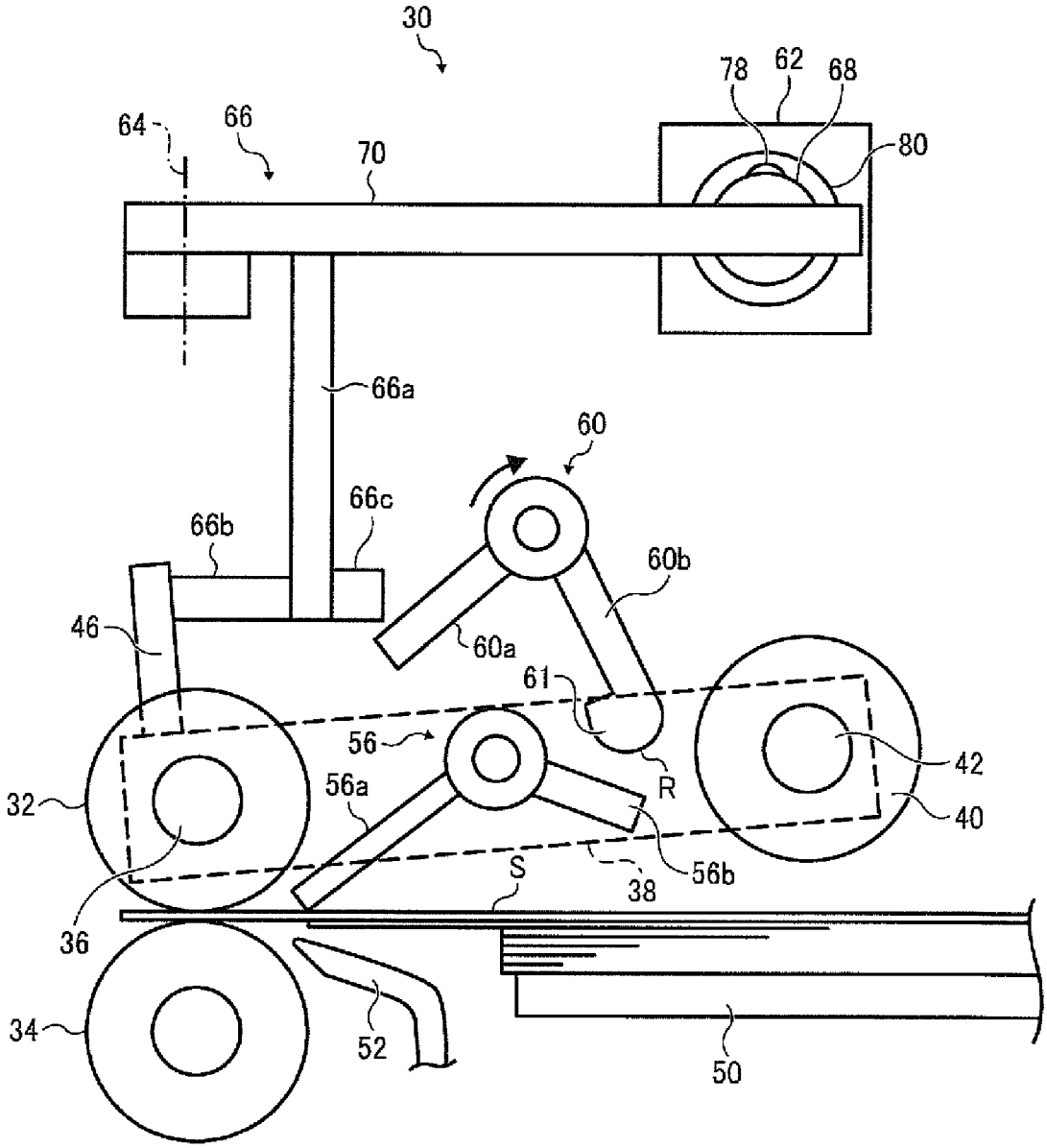
FIG. 7 is a vertical cross-sectional view illustrating the configuration of the manual sheet feeder when sheet feeding is performed.

When the solenoid link 66 is rotated, the second arm 66*b* of the solenoid link 66 pushes the contact arm 46 of the pickup arm 38 as illustrated in FIG. 7 to rotate the pickup arm 38 around the shaft 36 in a counterclockwise direction in FIG. 7. As a result, the pickup roller 40 is moved upward. Thereafter, the top sheet S is conveyed only by the sheet feed roller 32 and the separation roller 34. At this time, the rotation regulation member 60 is biased by the torsion spring 63 to rotate in a clockwise direction in FIG. 7, so that the first arm 60*a* of the rotation regulation member 60 contacts the third arm 66*c* of the solenoid link 66.

When the rear edge of the top sheet S passes between the sheet feed roller 32 and the separation roller 34, the solenoid 62 is turned on, and the second arm 66*b* of the solenoid link 66 is separated from the contact arm 46 of the pickup arm 38 to return to the state illustrated in FIG. 6. Thereafter, the next sheet is fed from the sheet tray 50.

The series of operations illustrated in FIGS. 6 and 7 is repeatedly performed to sequentially feed the sheets S from the sheet tray 50 and convey the sheets S between the sheet feed roller 32 and the separation roller 34. Sheet feeding is stopped when copy of a document is completed or all the sheets S placed on the sheet tray 50 are fed.

Figure 8:
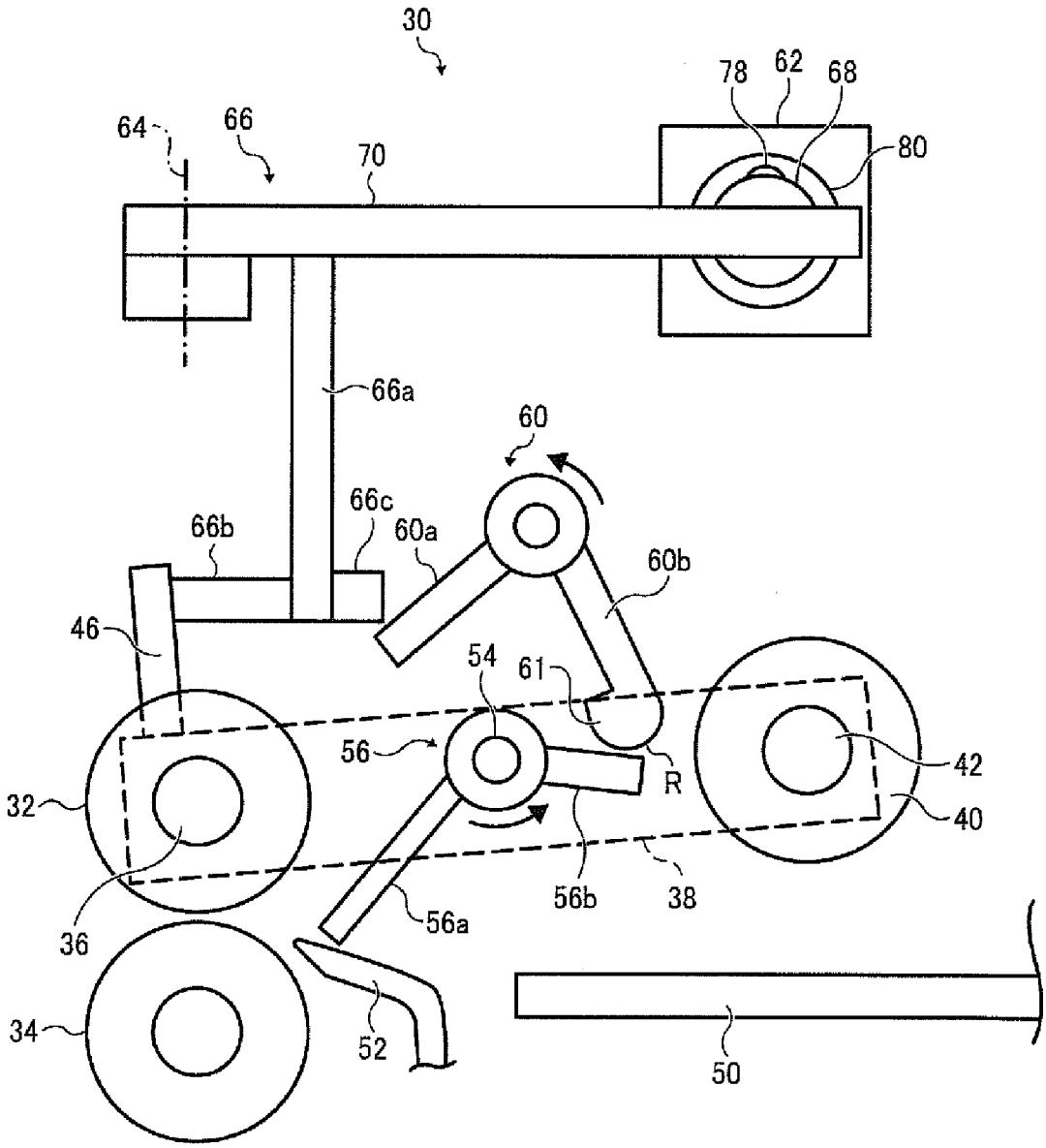
FIG. 8 is a vertical cross-sectional view illustrating the configuration of the manual sheet feeder when sheet feeding is completed.

FIG. 8 illustrates a state in which the sheet tray 50 is empty after the last sheet of the stack of the sheets S (hereinafter referred to as a last sheet S) is fed from the sheet feed roller 32 and the separation roller 34. When the last sheet S is fed from the sheet feed roller 32 and the separation roller 34, rotation of each of the sheet feed roller 32 and the separation roller 34 is stopped. At this time, the sheet stopper 56 is returned to the standby position by a force applied from the torsion spring 57 so that the sheet stopper 56 is rotated around the shaft 54 in a counterclockwise direction in FIG. 8. Simultaneously, the second arm 56*b* of the sheet stopper 56 contacts the curved surface R of the protrusion 61 provided at the leading edge of the second arm 60*b* of the rotation regulation member 60.

The second arm 56*b* of the sheet stopper 56 pushes the protrusion 61 provided at the leading edge of the second arm 60*b* of the rotation regulation member 60 upward. Because the outer surface of the protrusion 61 is formed with the curved surface R as described above, the rotation regulation member 60 is rotated in a counterclockwise direction against a force in the clockwise direction applied from the torsion spring 63. Thereafter, the leading edge of the second arm 56*b* of the sheet stopper 56 engages with the protrusion 61 provided at the leading edge of the second arm 60*b* of the rotation regulation member 60 to return to the state illustrated in FIG. 3A.

A description is now given of an image forming apparatus 100 employing the manual sheet feeder 30 described above.

Figure 9:
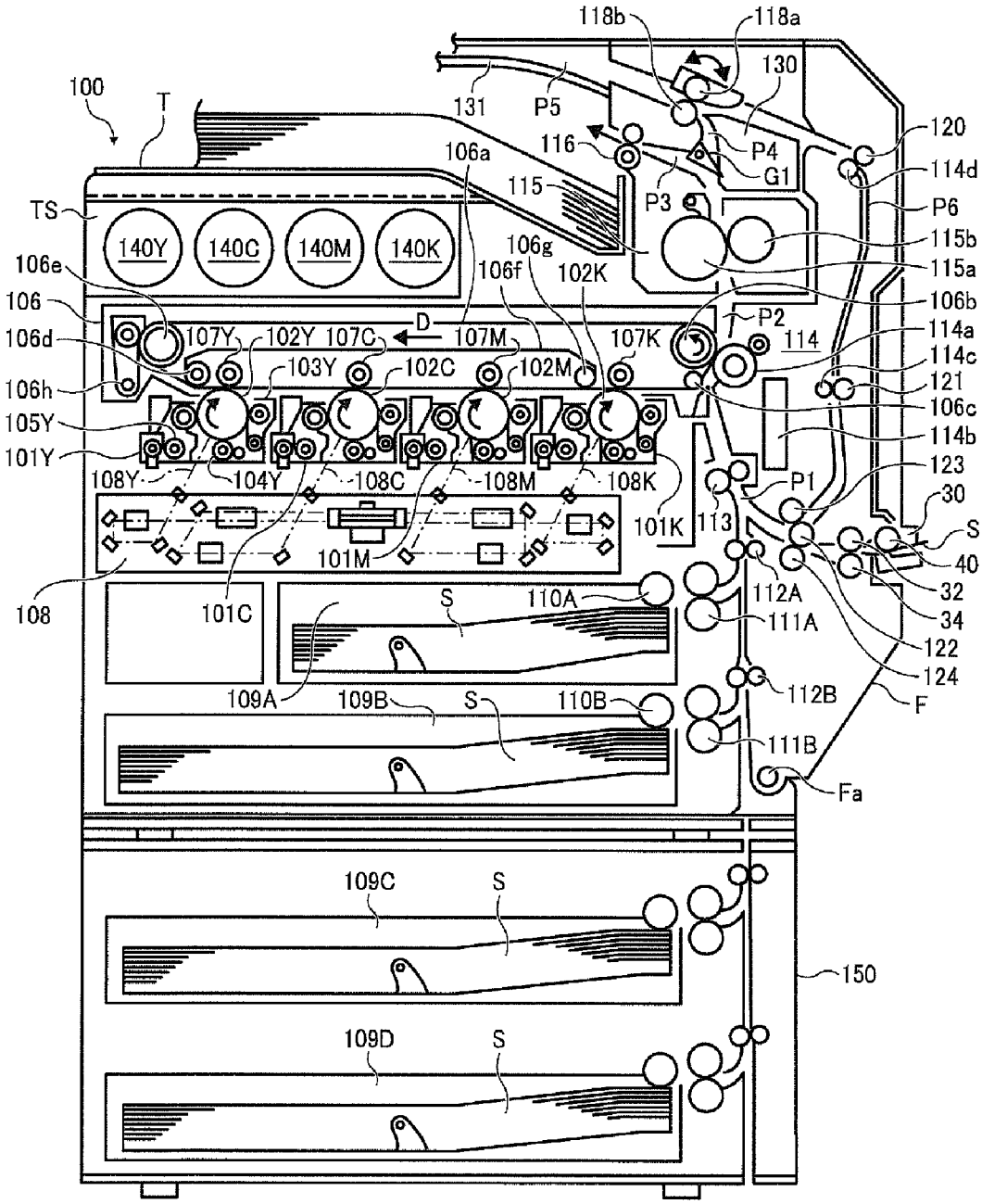
FIG. 9 is a vertical cross-sectional view illustrating a configuration of an image forming apparatus according to illustrative embodiments.

The image forming apparatus 100 according to illustrative embodiments is a tandem type full-color printer. FIG. 9 is a vertical cross-sectional view illustrating a configuration of the image forming apparatus 100.

In the image forming apparatus 100, four image forming units 101Y, 101C, 101M, and 101K (hereinafter collectively referred to as image forming units 101) are arranged parallel to one another in a vertical direction in FIG. 9 at equal intervals to form images of a specific color of yellow (Y), cyan (C), magenta (M), or black (K). Each of the four image forming units 101 has the same basic configuration, differing only in the color of toner used. It is to be noted that suffixes Y, C, M, and K are added to reference numerals for those components provided in each of the image forming units 101 to correspond to a color of a toner image formed by the corresponding image forming units 101.

The image forming units 101 include drum-type photoconductors 102Y, 102C, 102M, and 102K, respectively (hereinafter collectively referred to as photoconductors 102). When the image forming apparatus 100 is operated, the photoconductors 102 are rotated by a drive source, not shown. It is to be noted that, alternatively, a belt-type photoconductor may be used as the photoconductors 102.

As illustrated in FIG. 9, a charger 104Y, a developing device 105Y, a cleaning device 103Y, and so forth are provided around the photoconductors 102Y. Although not denoted by reference numerals in FIG. 9, chargers 104C, 104M, and 104K; developing devices 105C, 105M, and 105K; and cleaning devices 103C, 103W, and 103K are provided respectively around the photoconductors 102C, 102M, and 102K. It is to be noted that the chargers 104Y, 104C, 104W, and 104K; the developing devices 105Y, 105C, 105M, and 105K; and the cleaning devices 103Y, 103C, 103M, and 103K are hereinafter collectively referred to as the chargers 104; the developing devices 105; and the cleaning devices 103, respectively.

An irradiating device 108 to scan laser beams corresponding to image data of the respective colors on surfaces of the photoconductors 102 evenly charged by the chargers 104 to form electrostatic latent images of the respective colors is provided below the photoconductors 102. A narrow space extending in a direction of a rotary axis of each of the photoconductors 102 is provided between each of the chargers 104 and the developing devices 105, such that the laser beams emitted from the irradiating device 108 are directed to the surfaces of the photoconductors 102.

The irradiating device 108 employs a laser scanning method using a laser light source, a polygon mirror, and so forth. The irradiating device 108 emits laser beams 108Y, 108C, 108M, and 108K (hereinafter collectively referred to as laser beams 108), each modulated based on image data to be formed, from four semiconductor lasers, not shown. The irradiating device 108 includes a housing formed of metal or resin to store optical components and control members. A translucent dust-proof member is provided at each of output openings on an upper surface of the irradiating device 108.

Although the irradiating device 108 includes a single housing according to illustrative embodiments, alternatively, multiple irradiating devices may be provided respectively for the image forming units 101. Further, in place of the irradiating device 108 using the laser beams as described above, alternatively, an irradiating device using a combination of the well-known LED arrays and the imaging means may be used.

When toner of each color of yellow, cyan, magenta, or black is consumed by the corresponding developing devices 105, a toner detector, not shown, detects shortage of the toner, so that replenishing toner is supplied by supply means, not shown, to the corresponding developing devices 105 from toner cartridges 140Y, 140C, 140M, or 140K each storing toner of a specific color of yellow, cyan, magenta, or black and provided in an upper portion of the image forming apparatus 100. In order to prevent toner of different color from being supplied to the developing devices 105 because the toner cartridges 140Y, 140C, 140M, or 140K is set at a position not corresponding to the specific color, erroneous attachment prevention means is provided. For example, a storage TS is shaped corresponding to a shape of each of the toner cartridges 140Y, 140C, 140M, and 140K.

An intermediate transfer unit 106 is provided above the photoconductors 102. A roller 106*b* is rotated such that an intermediate transfer belt 106*a* wound around multiple rollers 106*b*, 106*c*, 106*d*, and 106*e* is rotated in a direction indicated by an arrow D in FIG. 9.

The intermediate transfer belt 106*a* is a seamless belt, and is arranged to contact to a part of each of the photoconductors 102 after development. Primary transfer rollers 107Y, 107C, 107M, and 107K are provided opposite the photoconductors 102 in an inner circumferential portion of the intermediate transfer belt 106*a*.

A cleaning device 106*h* is provided opposite the roller 106*e* outside the intermediate transfer belt 106*a*. The cleaning device 106*h* removes any foreign substance such as residual toner and paper dust adhering to a surface of the intermediate transfer belt 106*a*. The roller 106*e* provided opposite the cleaning device 106*h* includes a mechanism to apply tension to the intermediate transfer belt 106*a*. The roller 106*e* is moved to constantly provide appropriate tension to the intermediate transfer belt 106*a*, and the cleaning device 106*h* is moved in conjunction with movement of the roller 106*e*.

A secondary transfer roller 114*a* is provided near the roller 106*b* outside the intermediate transfer belt 106*a*. A bias is applied to the secondary transfer roller 114*a* so that a full-color toner image borne by the intermediate transfer belt 106*a* is electrostatically transferred onto the sheet S passing between the intermediate transfer belt 106*a* and the secondary transfer roller 114*a*.

Two sheet feed cassettes 109A and 109B positioned one above the other are drawably provided below the irradiating device 108. The sheet S stored in the sheet feed cassette 109A or 109B is selectively fed by rotation of a pickup unit 110A or 110B corresponding to the sheet feed cassette 109A or 109B, and is conveyed to a conveyance path P1 by a separation unit 111A or 111B and a pair of conveyance rollers 112A or 112B.

A pair of registration rollers 113 is provided along the conveyance path P1 to convey the sheet S to a secondary transfer position in synchronization with the full-color toner image formed on the intermediate transfer belt 106*a*. The sheet S is conveyed from the pair of the registration rollers 113 to the secondary transfer position formed between the intermediate transfer belt 106*a* and the secondary transfer roller 114*a*.

The manual sheet feeder 30 according to illustrative embodiments provided on a right lateral surface of the image forming apparatus 100 illustrated in FIG. 9 is rotated when not in use to be stored in a frame F which is a part of the image forming apparatus 100. The top sheet S stored in the manual sheet feeder 30 is fed between the sheet feed roller 32 and the separation roller 34 by the pickup roller 40, and is conveyed to the pair of the registration rollers 113 by a pair of conveyance rollers 122 and 124 through the conveyance path P1. The configuration and operations of the manual sheet feeder 30 are like that described above.

A fixing device 115 including heating means is provided above the intermediate transfer unit 106. Although the fixing device 115 includes rollers 115*a* and 115*b* each having a heater therein, alternatively, a belt may be used in place of the rollers 115*a* and 115*b*. Further alternatively, an induction heater may be used as the heating means.

A switching guide G1 is rotatable. When the switching guide G1 is in a state as illustrated in FIG. 9, the sheet S having a fixed full-color toner image thereon is guided to a discharge path P3, and is discharged to a discharge stack T provided at the top of the image forming apparatus 100 by a pair of discharge rollers 116.

The image forming apparatus 100 further includes a conveyance path and rollers for reversing and re-feeding the sheet S so that images are automatically formed on both sides of the sheet S. Specifically, a switchback path P5 is provided above the discharge stack T.

The sheet S fed from the manual sheet feeder 30 is conveyed to the secondary transfer position and the fixing device 115 so that an image is formed on a front side of the sheet S.

The switching guide G1 is rotated in a clockwise direction in FIG. 9 so that the sheet S having the image on the front side thereof is conveyed to a pair of reversely rotatable conveyance rollers 118*a* and 118*b* through a conveyance path P4, a part of which is formed by a left lateral surface of a sheet guide 130. Thereafter, the sheet S is guided by the pair of the conveyance rollers 118*a* and 118*b* to the switchback path P5 formed by an inner tray 131.

After a rear edge of the sheet P passes through a leading edge of the sheet guide 130 positioned on a downstream side relative to the direction of conveyance of the sheet S, the conveyance roller 118*a* is rotated in a counterclockwise direction in FIG. 9 to guide the sheet S to a re-feeding path P6.

The sheet S passes through the pair of the conveyance rollers 120 and 114*d* and the pair of the conveyance rollers 121 and 114*c* respectively provided along the re-feeding path P6 and is conveyed to a position where the reversely rotatable drive roller 122 and a roller 123 contact each other. The sheet S sandwiched between the drive roller 122 and the roller 123 is then conveyed to the pair of the registration rollers 113 again through the conveyance path P1.

The image forming apparatus 100 illustrated in FIG. 9 further includes a sheet feeder 150 at the bottom thereof. According to illustrative embodiments, two sheet feed cassettes 109C and 109D are provided within the sheet feeder 150. Alternatively, a number of the sheet feed cassettes may be increased, or a large-capacity sheet feed cassette capable of storing a larger number of sheets than normal may be built into the sheet feeder 150.

A description is now given of operations of the image forming apparatus 100 with the above-described configuration in a case in which an image is formed on only one side of the sheet S, that is, the front side of the sheet S.

The laser beam 108Y corresponding to image data of yellow emitted from the semiconductor laser by the operation of the irradiating device 108 is directed onto the surface of the photoconductor 102Y evenly charged by the charger 104Y to form an electrostatic latent image of yellow on the surface of the photoconductor 102Y.

The electrostatic latent image of yellow thus formed on the surface of the photoconductor 102Y is then developed by the developing device 105Y with toner of yellow to form a toner image of yellow. The toner image of yellow thus formed is primarily transferred by a primary transfer roller 107Y onto the surface of the intermediate transfer belt 106*a* rotated in synchronization with the photoconductor 102Y. The above-described series of electrostatic latent image formation, development, and primary transfer is also sequentially performed by the photoconductors 102C, 102M, and 102K with an appropriate timing.

As a result, the toner images of yellow, cyan, magenta, and black are sequentially superimposed on one another on the surface of the intermediate transfer belt 106*a* so that a full-color toner image is formed on the surface of the intermediate transfer belt 106*a*. The full-color toner image thus formed is borne on the surface of the intermediate transfer belt 106*a* and is moved in the direction indicated by the arrow D in FIG. 9 along with rotation of the intermediate transfer belt 106*a*. Meanwhile, the surface of each of the photoconductors 102 is cleaned by the cleaning devices 103, respectively, to remove any foreign substance such as residual toner adhering to the surfaces of each of the photoconductors 102.

The full-color toner image formed on the surface of the intermediate transfer belt 106*a* is secondarily transferred onto the front side of the sheet S conveyed in synchronization with rotation of the intermediate transfer belt 106*a* by the secondary transfer roller 114*a*. Thereafter, the surface of the intermediate transfer belt 106*a* is cleaned by the cleaning device 106*h* to be ready for the next series of image formation and transfer operations.

The full-color toner image transferred onto the front side of the sheet S is fixed to the sheet S by the fixing device 115. Thereafter, the sheet S having a fixed image on the front side thereof is discharged by the discharge roller 116 to the discharge stack T with the side of the sheet S having the fixed image, that is, the front side of the sheet S, facing down.

A description is now given of operations of the image forming apparatus 100 when images are formed on both sides of the sheet S, that is, the front and back sides of the sheet S.

As described above, first, the full-color toner image is transferred onto the front side of the sheet S from the intermediate transfer belt 106*a*, and the sheet S having the transferred full-color toner image on the front side thereof is conveyed to the fixing device 115. After the full-color toner image is fixed to the front side of the sheet S by the fixing device 115, the sheet S is guided by the switching guide G1 to the pair of the conveyance rollers 118*a* and 118*b*. Subsequently, the sheet S is conveyed to the conveyance path P5 formed by the inner tray 131 by the pair of the conveyance rollers 118*a* and 118*b*. When the rear edge of the sheet S passes through the leading edge of the sheet guide 130, the reversely-rotatable drive roller 118*a* is rotated in a counter-clockwise direction in FIG. 9 so that the rear edge of the sheet S is now turned into a leading edge of the sheet S, and the sheet S is conveyed between the pair of the rollers 122 and 123 by the pairs of the rollers 114*d* and 120, and 114*c* and 121. Thereafter, the sheet S is conveyed to the pair of the registration rollers 113 as described above. The sheet S having the image on the front side thereof is again conveyed by the pair of the registration rollers 113 with an appropriate timing to the secondary transfer position where the secondary transfer roller 114*a* is provided. Accordingly, a full-color toner image formed on the surface of the intermediate transfer belt 106*a* is transferred onto the back side of the sheet S.

The full-color toner image to be transferred onto the back side of the sheet S is formed on the intermediate transfer belt 106*a* in a way similar to formation of the full-color toner image for the front side of the sheet S as described above when the sheet S is conveyed to a predetermined position. However, because the leading and rear edges of the sheet S are reversed as described above, the laser beams 108 respectively directed to the surfaces of the photoconductors 102 are controlled such that image data is formed from a reverse side thereof in the direction of conveyance of the sheet S compared to a side of the image data first formed for the front side of the sheet S.

The sheet S having the transferred full-color toner image on the back side thereof is again conveyed to the fixing device 115 so that the full-color toner image is fixed to the back side of the sheet S. Thereafter, the sheet S having images on both the front and back sides thereof is discharged to the discharge stack T by the discharge roller 116.

In order to efficiently form the images on both the front and back sides of the sheet S, multiple sheets S can be consecutively conveyed through the conveyance paths within the image forming apparatus 100 at the same time. It is to be noted that a timing to form the images for the front and back sides of the sheet S is controlled by control means, not shown.

Although formation of the full-color images on the single side or the both sides of the sheet S is described above, the image forming units 101Y, 101C, and 101M are not operated when monochrome images are formed by the image forming apparatus 100. The image forming apparatus 100 includes a mechanism to separate the photoconductors 102Y, 102C, and 102M from the intermediate transfer belt 106*a* during monochrome image formation. Specifically, the roller 106*d* and an internal frame 106*f* supporting the primary transfer rollers 107Y, 107C, and 107M are rotatably supported with a shaft 106*g* acting as a pivot. Accordingly, when the roller 106*d* and the internal frame 106*f* are rotated in a direction of separating from the photoconductors 102Y, 102C, and 102M, that is, a clockwise direction in FIG. 9, only the photoconductor 102K contacts the intermediate transfer belt 106*a* to form a monochrome image with toner of black.

When a paper jam occurs in the conveyance paths of the image forming apparatus 100, the frame F is rotated around a rotary shaft Fa provided at the bottom of the frame F so that an upper portion of the frame F can be opened. A lock lever, not shown, is operated to open the frame F, so that almost all the conveyance paths within the image forming apparatus 100 are exposed. As a result, the sheet S jammed in the conveyance paths can be easily removed, and further, maintenance such as cleaning can be easily performed.

A secondary transfer unit 114 provided between the conveyance paths P2 and P6 is rotatable around a shaft of the roller 123, such that the secondary transfer roller 114*a* is separated from the intermediate transfer belt 106*a*, and the rollers 114*c* and 114*d* are separated from the rollers 121 and 120, respectively, when the frame F is opened.

The secondary transfer unit 114 includes a power source 114*b* therein, and external surfaces of a casing of the secondary transfer unit 114 function to convey the sheet S.

The manual sheet feeder 30 according to the foregoing illustrative embodiments is applicable not only to image forming apparatuses such as full-color printers, but also to copiers, facsimile machines, printers, and so forth.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2008-308076 filed on Dec. 3, 2008 in the Japan Patent Office, the entire contents of which are hereby incorporated herein by reference.

What is claimed is:

1. A manual sheet feeder, comprising:

a pickup roller provided to contact a sheet placed on a sheet tray to convey the sheet to a sheet feed roller;

a pickup arm rotatably provided to a shaft of the sheet feed roller to rotatably support the pickup roller;

a sheet stopper rotatably provided to stop and align a leading edge of the sheet placed on the sheet tray;

a rotation regulation member rotatably provided to regulate rotation of the sheet stopper in a direction of sheet feed by engaging with the sheet stopper positioned at a standby position;

a solenoid comprising a movable core having a straight line motion;

a solenoid link rotatively coupled to the movable core; and a first spring to bias the pickup arm in a direction in which the pickup arm is rotated downward, wherein at start of sheet feeding operation:

the pickup arm is rotated by the first spring in a direction in which the pickup roller is moved downward in conjunction with rotation of the solenoid link caused by the straight line motion of the movable core in one direction; and the rotation regulation member is rotated in conjunction with the rotation of the solenoid link caused by the straight line motion of the movable core in the one direction to release regulation of rotation of the sheet stopper by releasing engagement with the sheet stopper, and wherein the manual sheet feeder further comprising further comprises:

a second spring to bias the sheet stopper to rotate the sheet stopper in a direction opposite the direction of sheet feed; and a third spring to bias the rotation regulation member to rotate the rotation regulation member in a direction in which rotation of the sheet stopper is regulated at the standby position, wherein at completion of the sheet feeding operation:

the pickup arm is rotated in a direction in which the pickup roller is moved upward in conjunction with rotation of the solenoid link caused by the straight line motion of the movable core in the other direction;

the rotation regulation member is rotated by the third spring in conjunction with the rotation of the solenoid link caused by the straight line motion of the movable core in the other direction; and the sheet stopper engages with the rotation regulation member when being rotated and returned to the standby position by the second spring to regulate the rotation of the sheet stopper.

2. The manual sheet feeder according to claim 1, wherein during the sheet feeding operation:

the movable core has the straight line motion in the other direction when a rear edge of the sheet passes through the pickup roller, and the pickup arm is rotated in the direction in which the pickup roller is moved upward in conjunction with the rotation of the solenoid link caused by the straight line motion of the movable core in the other direction to stop feeding of the sheet placed on the sheet tray; and the movable core has the straight line motion in the one direction when the sheet passes through the sheet feed roller, and the pickup arm is rotated by the first spring in the direction in which the pickup roller is moved downward in conjunction with the rotation of the solenoid link caused by the straight line motion of the movable core in the one direction to start feeding of the sheet placed on the sheet tray.

3. The manual sheet feeder according to claim 1, wherein:

the sheet stopper is rotatably supported to a first shaft, the sheet stopper comprising a first arm and a second arm each extending in a direction perpendicular to a longitudinal direction of the first shaft;

the rotation regulation member is rotatably supported to a second shaft, the rotation regulation member comprising a first arm and a second arm each extending in a direction perpendicular to a longitudinal direction of the second shaft;

the second arm of the rotation regulation member comprises a protrusion at a leading edge thereof to engage with a leading edge of the second arm of the sheet stopper, the protrusion having a curved surface on an external surface thereof; and the protrusion of the second arm of the rotation regulation member engages with the second arm of the sheet stopper positioned at the standby position to engage the rotation regulation member and the sheet stopper with each other so that the first arm of the sheet stopper positioned at the standby position stops and aligns the leading edge of the sheet placed on the sheet tray.

4. The manual sheet feeder according to claim 3, wherein the first arm of the rotation regulation member is pressed by the rotation of the solenoid link caused by the straight line motion of the movable core in the one direction to rotate the rotation regulation member to release the protrusion of the second arm of the rotation regulation member from the leading edge of the second arm of the sheet stopper so that engagement of the rotation regulation member with the sheet stopper is released.

5. The manual sheet feeder according to claim 3, wherein the leading edge of the second arm of the sheet stopper contacts the curved surface of the protrusion of the second arm of the rotation regulation member to rotate the rotation regulation member in a direction opposite a direction in which the third spring biases the rotation regulation member to engage the leading edge of the second arm of the sheet stopper with the protrusion of the second arm of the rotation regulation member so that the sheet stopper engages with the rotation regulation member.

6. An image forming apparatus comprising a manual sheet feeder, the manual sheet feeder comprising:

a pickup roller provided to contact a sheet placed on a sheet tray to convey the sheet to a sheet feed roller;

a pickup arm rotatably provided to a shaft of the sheet feed roller to rotatably support the pickup roller;

a sheet stopper rotatably provided to stop and align a leading edge of the sheet placed on the sheet tray;

a rotation regulation member rotatably provided to regulate rotation of the sheet stopper in a direction of sheet feed by engaging with the sheet stopper positioned at a standby position;

a solenoid comprising a movable core having a straight line motion;

a solenoid link rotatively coupled to the movable core; and a first spring to bias the pickup arm in a direction in which the pickup arm is rotated downward, wherein at start of sheet feeding operation, the pickup arm is rotated by the first spring in a direction in which the pickup roller is moved downward in conjunction with rotation of the solenoid link caused by the straight line motion of the movable core in one direction, and the rotation regulation member is rotated in conjunction with the rotation of the solenoid link caused by the straight line motion of the movable core in the one direction to release regulation of rotation of the sheet stopper by releasing engagement with the sheet stopper wherein the manual sheet feeder further comprises:

a second spring to bias the sheet stopper to rotate the sheet stopper in a direction opposite the direction of sheet feed; and a third spring to bias the rotation regulation member to rotate the rotation regulation member in a direction in which rotation of the sheet stopper is regulated at the standby position, wherein at completion of the sheet feeding operation:

the pickup arm is rotated in a direction in which the pickup roller is moved upward in conjunction with rotation of the solenoid link caused by the straight line motion of the movable core in the other direction;

the rotation regulation member is rotated by the third spring in conjunction with the rotation of the solenoid link caused by the straight line motion of the movable core in the other direction; and the sheet stopper engages with the rotation regulation member when being rotated and returned to the standby position by the second spring to regulate the rotation of the sheet stopper.

7. The image forming apparatus according to claim 6, wherein the image forming apparatus is a copier.

8. The image forming apparatus according to claim 6, wherein the image forming apparatus is a printer.

9. The image forming apparatus according to claim 6, wherein during the sheet feeding operation:

the movable core has the straight line motion in the other direction when a rear edge of the sheet passes through the pickup roller, and the pickup arm is rotated in the direction in which the pickup roller is moved upward in conjunction with the rotation of the solenoid link caused by the straight line motion of the movable core in the other direction to stop feeding of the sheet placed on the sheet tray; and the movable core has the straight line motion in the one direction when the sheet passes through the sheet feed roller, and the pickup arm is rotated by the first spring in the direction in which the pickup roller is moved downward in conjunction with the rotation of the solenoid link caused by the straight line motion of the movable core in the one direction to start feeding of the sheet placed on the sheet tray.

10. The image forming apparatus according to claim 6, wherein:

the sheet stopper is rotatably supported to a first shaft, the sheet stopper comprising a first arm and a second arm each extending in a direction perpendicular to a longitudinal direction of the first shaft;

the rotation regulation member is rotatably supported to a second shaft, the rotation regulation member comprising a first arm and a second arm each extending in a direction perpendicular to a longitudinal direction of the second shaft;

the second arm of the rotation regulation member comprises a protrusion at a leading edge thereof to engage with a leading edge of the second arm of the sheet stopper, the protrusion having a curved surface on an external surface thereof; and the protrusion of the second arm of the rotation regulation member engages with the second arm of the sheet stopper positioned at the standby position to engage the rotation regulation member and the sheet stopper with each other so that the first arm of the sheet stopper positioned at the standby position stops and aligns the leading edge of the sheet placed on the sheet tray.

11. The image forming apparatus according to claim 10, wherein the first arm of the rotation regulation member is pressed by the rotation of the solenoid link caused by the straight line motion of the movable core in the one direction to rotate the rotation regulation member to release the protrusion of the second arm of the rotation regulation member from the leading edge of the second arm of the sheet stopper so that engagement of the rotation regulation member with the sheet stopper is released.

12. The image forming apparatus according to claim 10, wherein the leading edge of the second arm of the sheet stopper contacts the curved surface of the protrusion of the second arm of the rotation regulation member to rotate the rotation regulation member in a direction opposite a direction in which the third spring biases the rotation regulation member to engage the leading edge of the second arm of the sheet stopper with the protrusion of the second arm of the rotation regulation member so that the sheet stopper engages with the rotation regulation member.

* * * * *